US008651404B2

(12) United States Patent
Chang

(10) Patent No.: US 8,651,404 B2
(45) Date of Patent: Feb. 18, 2014

(54) SHREDDER WITH CLIP REMOVING STRUCTURE

(75) Inventor: Ping-Huai Chang, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/592,996

(22) Filed: Aug. 23, 2012

(65) Prior Publication Data

US 2013/0327862 A1 Dec. 12, 2013

(30) Foreign Application Priority Data

Jun. 6, 2012 (CN) ..... 201210184112

(51) Int. Cl.
*B02C 18/22* (2006.01)
*B02C 23/02* (2006.01)

(52) U.S. Cl.
USPC ..... 241/81; 241/225; 241/236; 241/100

(58) Field of Classification Search
USPC ..... 241/81, 100, 236, 224, 225
See application file for complete search history.

(56) References Cited

U.S. PATENT DOCUMENTS

| | | | | |
|---|---|---|---|---|
| 7,387,268 | B2 * | 6/2008 | Dahle et al. | 241/224 |
| 7,500,627 | B2 * | 3/2009 | Park et al. | 241/36 |
| 7,658,342 | B2 * | 2/2010 | Chang | 241/81 |
| 8,336,794 | B2 * | 12/2012 | Aries et al. | 241/81 |
| 2005/0274836 | A1 * | 12/2005 | Chang | 241/236 |
| 2006/0249609 | A1 * | 11/2006 | Huang | 241/224 |
| 2007/0181722 | A1 * | 8/2007 | Dahle et al. | 241/235 |
| 2010/0032505 | A1 * | 2/2010 | Jensen et al. | 241/25 |
| 2010/0032507 | A1 * | 2/2010 | Chen | 241/34 |
| 2010/0059612 | A1 * | 3/2010 | Huang | 241/33 |
| 2010/0096482 | A1 * | 4/2010 | Chang | 241/101.2 |

* cited by examiner

*Primary Examiner* — Faye Francis
(74) *Attorney, Agent, or Firm* — Evan R. Witt; Kirton McConkie

(57) ABSTRACT

A shredder includes a paper placement platform, a feeding roller assembly, and a shredding knife assembly. The paper placement platform includes four recesses. The four recesses are located adjacent to four corners of the paper placement platform, respectively. Moreover, plural clip removing bulges are discretely protruded from and arranged on a top surface of the paper placement platform beside each recess. The feeding roller assembly is arranged between the paper placement platform and the shredding knife assembly and exposed to the paper placement platform. During the paper on the paper placement platform is driven by the feeding roller assembly to be moved toward the shredding knife assembly, an edge of the paper is transferred through the plural clip removing bulges, so that a paperclip at the edge of the paper is blocked by the plural clip removing bulges to be separated from the paper.

16 Claims, 9 Drawing Sheets

SHREDDER WITH CLIP REMOVING STRUCTURE

FIELD OF THE INVENTION

The present invention relates to a shredder, and more particularly to a shredder with an automatic document feeder.

BACKGROUND OF THE INVENTION

A shredder is an office machine widely used to cut a document into strips or fine particles in order to prevent the confidential data of the document from being leaked. Generally, most of the shredders in homes and offices are designed for allowing the users to manually feed the documents into the shredders. However, if the number of documents exceeds the permissible number of the shredder at one time, the documents should be fed into the shredder in batches by the user. In other words, the operating way of the conventional shredder is not user-friendly. For solving the above drawbacks, a shredder with an automatic document feeder has been introduced into the market. By putting all of the documents into the shredder, the documents will be fed into the shredder one by one or in batches. Consequently, the documents may be cut by the shredder. However, in a case that the document contains one or more paperclips, it is necessary to remove the paperclips in advance before the documents are put into the shredder. If the paperclips are not removed from the documents in advance, the shredder will be disabled or even the shredder will be suffered from damage. Therefore, it is an important issue to remove the paperclips from the documents before the documents are cut into strips or fine particles.

Hereinafter, the components of a conventional shredder with a clip removing structure will be illustrated with reference to FIGS. 1, 2 and 3. FIG. 1 is a schematic perspective view illustrating a conventional shredder with a clip removing structure. FIG. 2 is a schematic exploded view illustrating the conventional shredder of FIG. 1. FIG. 3 is a schematic perspective view illustrating a portion of the conventional shredder of FIG. 1.

The shredder 1 comprises a casing 11, a waste bin 12, a paper shredding mechanism 13, a paper feeding mechanism 14, a paper feeding base 15, an upper cover 16, and four clip removing plates 17. The paper feeding mechanism 14 comprises plural rollers 14*a*. The paper feeding base 15 comprises plural openings 15*a* and four perforations 15*b*. The plural openings 15*a* are located at a middle portion of the paper feeding base 15. The four perforations 15*b* are located at four corners of the paper feeding base 15, respectively. Moreover, each of the four clip removing plates 17 has a rim part 17*a*.

Hereinafter, a process of assembling the conventional shredder with the clip removing structure will be illustrated with reference to FIGS. 2 and 3.

Firstly, the paper shredding mechanism 13 is installed within the casing 11. The paper feeding mechanism 14 is disposed over the paper shredding mechanism 13. Then, the paper feeding base 15 is disposed over the paper feeding mechanism 14. In addition, the plural rollers 14*a* of the paper feeding mechanism 14 are penetrated through the plural openings 15*a* of the paper feeding base 15 to be exposed to the surface of the paper feeding base 15. Then, the upper cover 16 is pivotally coupled to the paper feeding base 15. Consequently, the upper cover 16 may be rotated relative to the casing 11 to be selectively in an open position or a close position. Furthermore, the four clip removing plates 17 are fixed on the paper feeding base 15 at the regions adjacent to the four perforations 15*b*, respectively. In addition, each of the four rim parts 17*a* of the four clip removing plates 17 is aligned with a side of a corresponding perforation 15*b*. Moreover, the waste bin 12 is disposed under the paper shredding mechanism 13.

The operations of the conventional shredder with the clip removing structure will be illustrated in more details as follows. For performing the shredding operation, the upper cover 16 is firstly rotated relative to the casing 11 to be in the open position. Then, the papers to be cut are placed on the paper feeding base 15. Then, the upper cover 16 is closed (see FIG. 1), so that the papers are pressed by the upper cover 16. In such way, the bottommost paper is in close contact with the plural rollers 14*a* of the paper feeding mechanism 14.

When the shredding operation is started, the plural rollers 14*a* are rotated to transport the papers through the paper shredding mechanism 13 from the middle portion of the bottommost paper. By the paper shredding mechanism 13, the papers are cut into strips or fine particles, which will drop down to the waste bin 12.

It is noted that the four corners of each paper are respectively located over the four perforations 15*b* when the papers are placed on the paper feeding base 15. As the edges of the paper along with the middle portion of the paper are moved toward the plural rollers 14*a*, the four corners of the paper are respectively transferred through the four clip removing plates 17, which are located beside the four perforations 15*b*. Meanwhile, since the paper is in close contact with the paper feeding base 15 and the clip removing plates 17 by the upper cover 16, the paperclips fixed on the paper fail to be simultaneously moved with the paper. That is, during the process of moving the paper, the paperclips are continuously pushed by the rim parts 17*a* of the clip removing plates 17, so that the paperclips are gradually separated from the paper. Finally, the paperclips fall down to the waste bin 12 through the perforations 15*b*.

The conventional shredder 1, however, still has the following drawbacks. As previously described, in the conventional shredder 1, the rim parts 17*a* of the clip removing plates 17 beside the perforations 15*b* are employed to push the paperclips in order to separate the paperclips from the paper. Consequently, only when the rim parts 17*a* of the clip removing plates 17 are continuously in contact with the paperclips, the functions of the clip removing plates 17 can be achieved. Moreover, if the paper is upturned, the paperclips fail to be effectively pushed by the clip removing plates 17. For eliminating this problem, the paper should be completely in close contact with the clip removing plates 17.

However, during the shredding operation of the shredder 1 is performed, the shredder 1 is bound to generate vibration. Due to the vibration of the shredder 1, if the upper cover 16 is suffered from a slight shift, the paper fails to be in close contact with the clip removing plates 17. Since the contact area between the rim part 17*a* of the clip removing plate 17 and the paperclip is very small, the rim part 17*a* of the clip removing plate 17 and the paperclip fail to be precisely aligned with each other at this moment. Under this circumstance, the clip removing efficacy of the clip removing plate 17 is adversely affected. Moreover, if the upper cover 16 is loosened after a long use time, the clip removing plate 17 may malfunction.

Therefore, there is a need of providing a shredder with an improved clip removing structure in order to eliminate the drawbacks of the conventional shredder with the clip removing structure.

SUMMARY OF THE INVENTION

The present invention provides an automatic sheet-feeding shredder with a high-performance clip removing structure.

In accordance with an aspect of the present invention, there is provided a shredder with a clip removing structure. The shredder includes a casing, a shredding knife assembly, a paper placement platform, a feeding roller assembly, and plural clip removing bulges. The shredding knife assembly is disposed within the casing. The paper placement platform is disposed over the shredding knife assembly for supporting at least one paper thereon. The feeding roller assembly is arranged between the paper placement platform and the shredding knife assembly and exposed to the paper placement platform for driving movement of the paper toward the shredding knife assembly. The plural clip removing bulges are arranged on a top surface of the paper placement platform and located beside a corner of the paper placement platform. During the paper is driven by the feeding roller assembly to be moved toward the shredding knife assembly and an edge of the paper is transferred through the plural clip removing bulges, a paperclip at the edge of the paper is blocked by the plural clip removing bulges, so that the paperclip is separated from the paper.

In an embodiment, the highest altitude of each of the plural clip removing bulges relative to the top surface of the paper placement platform is in a range between 0.6 mm and 1.5 mm, and a width of each of the plural clip removing bulges is in a range between 0.6 mm and 1.5 mm.

In an embodiment, a spacing interval between each of the plural clip removing bulges and an adjacent clip removing bulge is smaller than a width of the paperclip.

In an embodiment, the paper placement platform includes a recess. The recess is located adjacent to the corner of the paper placement platform. In addition, the recess includes a sidewall extended downwardly from the top surface of the paper placement platform. The plural clip removing bulges are discretely arranged on the top surface of the paper placement platform beside the recess.

In an embodiment, each of the plural clip removing bulges includes an upper surface, wherein the upper surface is downwardly inclined toward the feeding roller assembly.

In an embodiment, each of the plural clip removing bulges further includes a lateral surface. The lateral surface is extended from the upper surface and connected with the sidewall of the recess, and the lateral surface is inclined toward the feeding roller assembly.

In an embodiment, the shredder further includes a receptacle. The receptacle is disposed under the casing. The paper after being cut by the shredding knife assembly and the paperclip after being transferred through the recess are accommodated within the receptacle.

In an embodiment, the paper placement platform includes four recesses. The four recesses are respectively located adjacent to four corners of the paper placement platform. In addition, each of the four recesses includes a sidewall extended downwardly from the top surface of the paper placement platform. The plural clip removing bulges are discretely arranged on the top surface of the paper placement platform beside each of the four recesses.

In an embodiment, each of the plural clip removing bulges includes an upper surface, wherein the upper surface is downwardly inclined toward the feeding roller assembly.

In an embodiment, each of the plural clip removing bulges further includes a lateral surface. The lateral surface is extended from the upper surface and connected with the sidewall of the corresponding recess, and the lateral surface is inclined toward the feeding roller assembly.

In an embodiment, the shredder further includes a receptacle, which is disposed under the casing. The paper after being cut by the shredding knife assembly and the paperclip after being transferred through the recesses are accommodated within the receptacle.

In an embodiment, the shredder further includes an upper cover, which is pivotally coupled to the casing. The upper cover is rotatable relative to the casing to be selectively in an open position or a close position. When the upper cover is in the close position, the paper on the paper placement platform is pressed by the upper cover.

In an embodiment, the paper placement platform further includes a hollow part. The hollow part is located at a middle portion of the paper placement platform. Moreover, the feeding roller assembly is exposed to the paper placement platform through the hollow part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
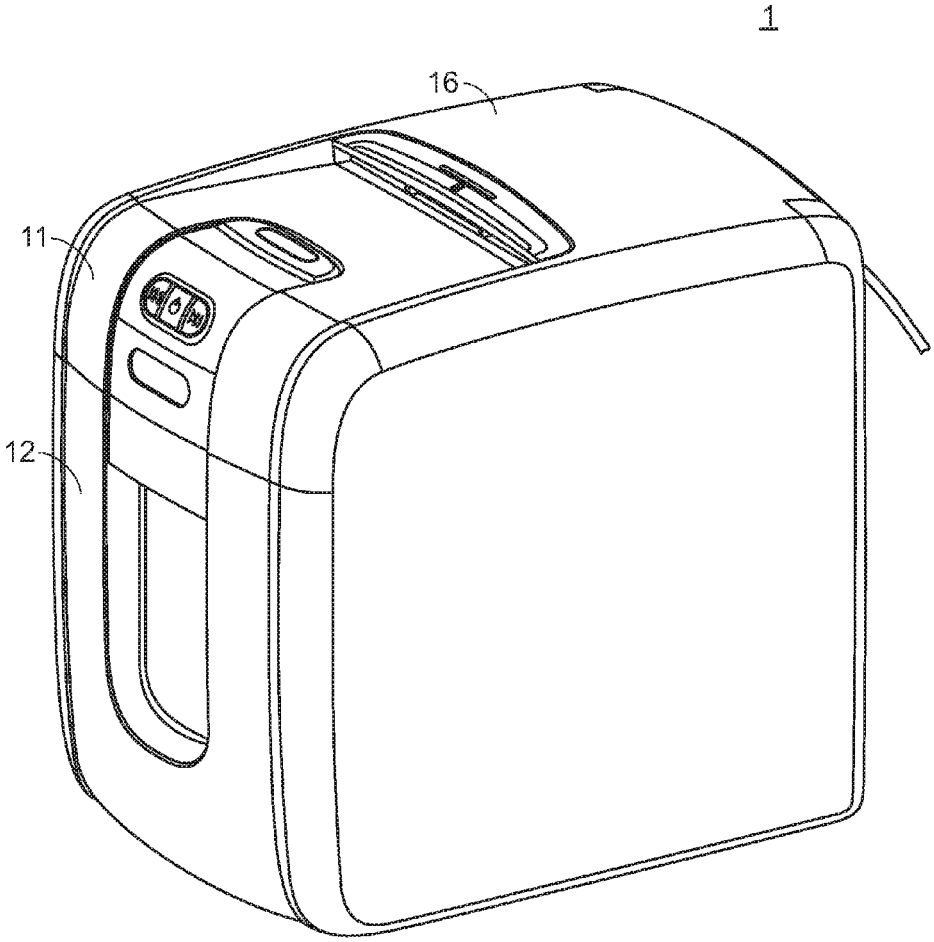
FIG.1 PRIOR ART
FIG. 1 is a schematic perspective view illustrating a conventional shredder with a clip removing structure.
Figure 2:
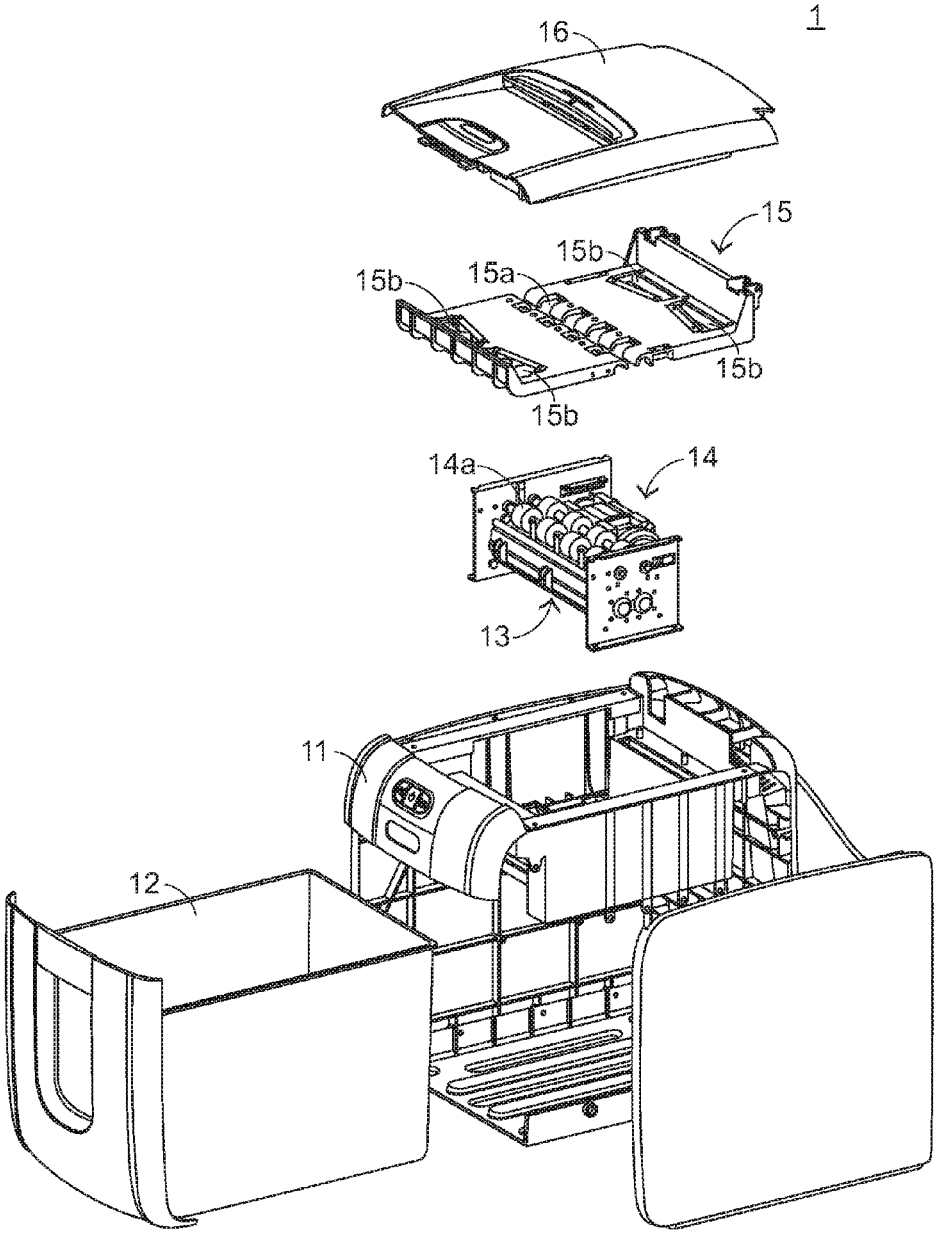
FIG.2 PRIOR ART
FIG. 2 is a schematic exploded view illustrating the conventional shredder of FIG. 1.
Figure 3:
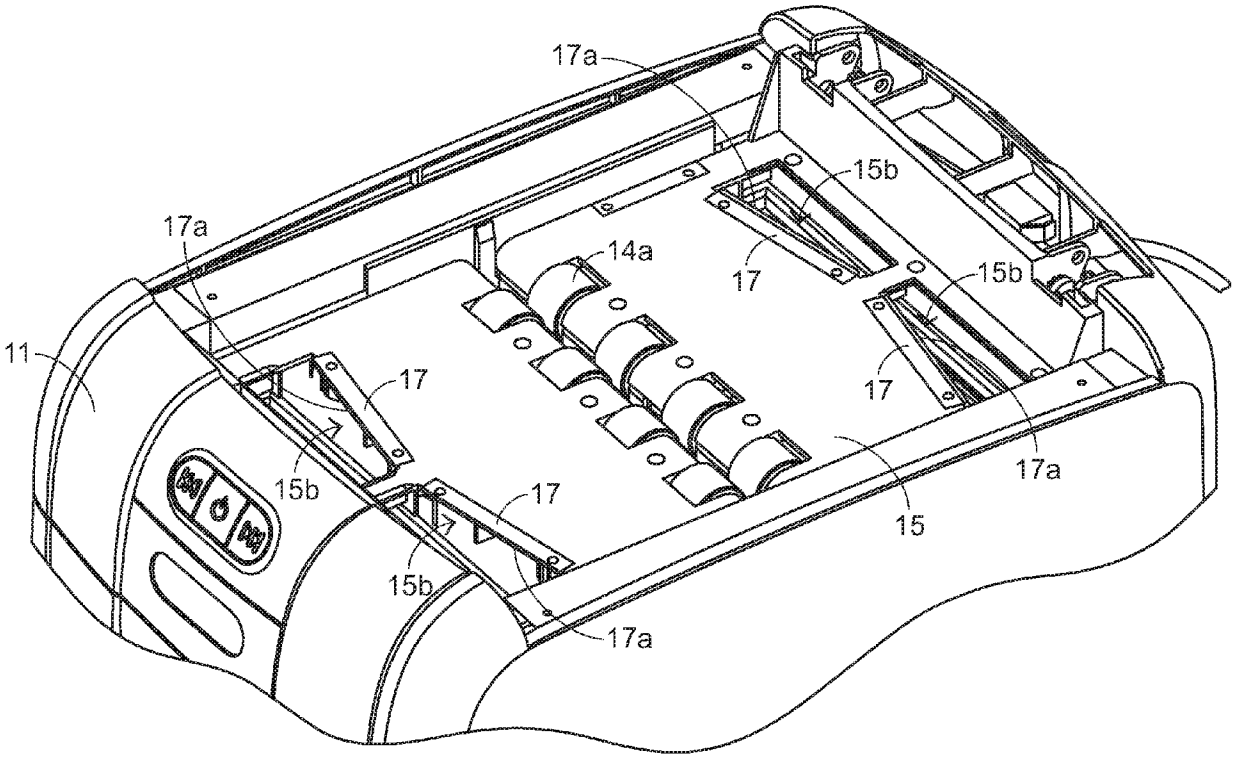
FIG.3 PRIOR ART
FIG. 3 is a schematic perspective view illustrating a portion of the conventional shredder of FIG. 1.
Figure 4:
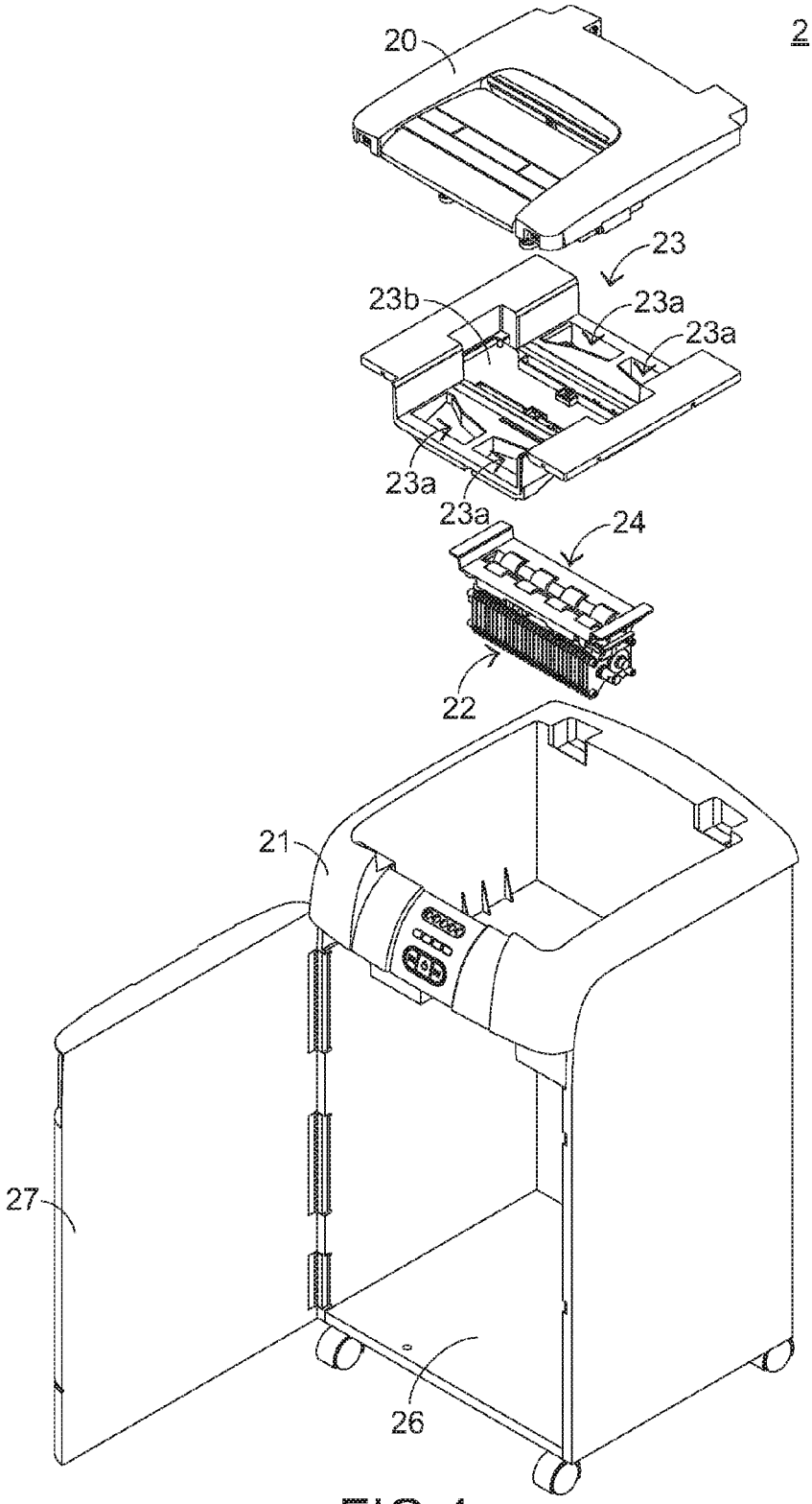
FIG. 4 is a schematic exploded view illustrating a shredder with a clip removing structure according to an embodiment of the present invention.
Figure 5:
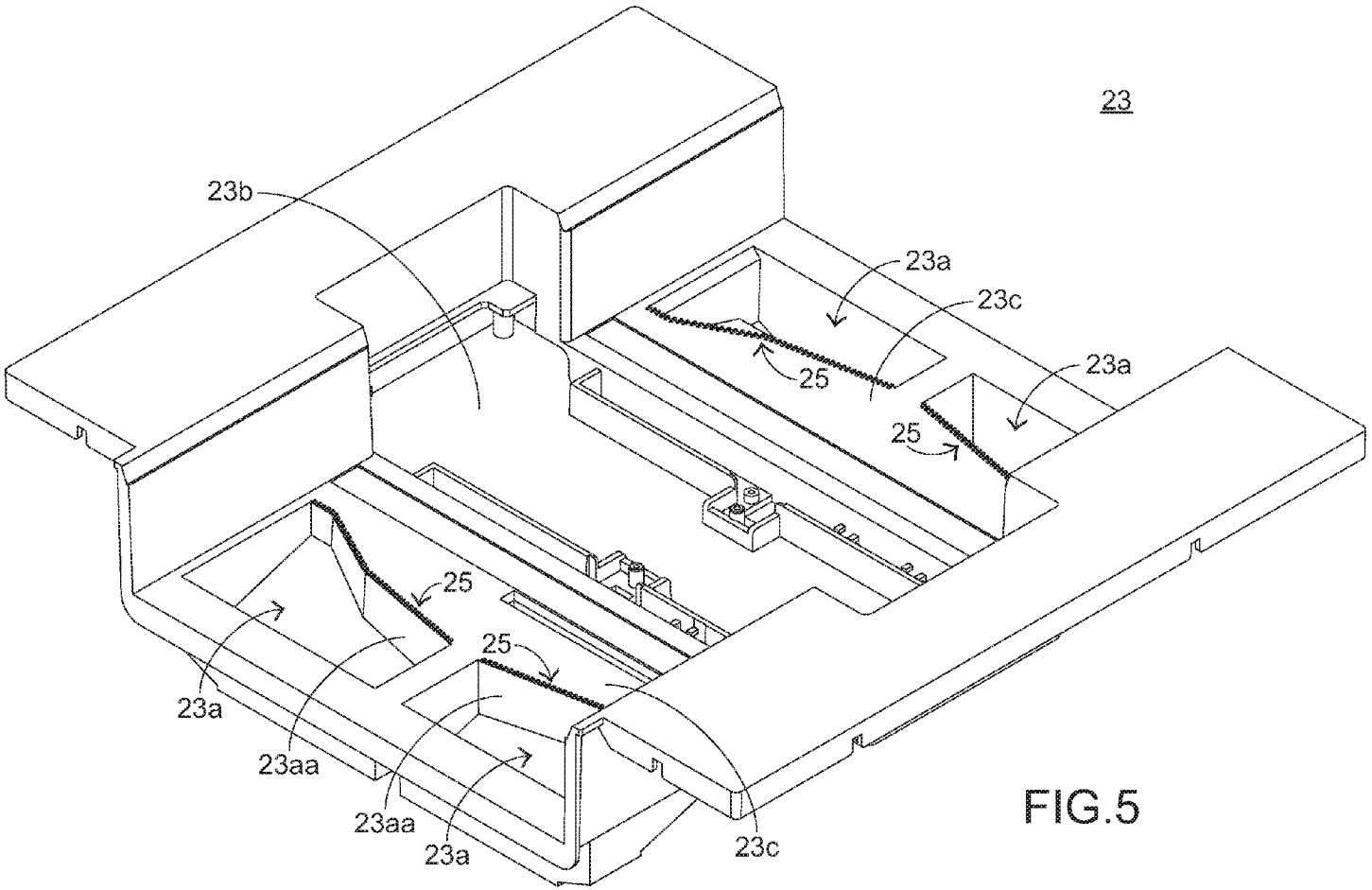
FIG. 5 is a schematic perspective view illustrating a paper placement platform used in the shredder of FIG. 4.
Figure 6:
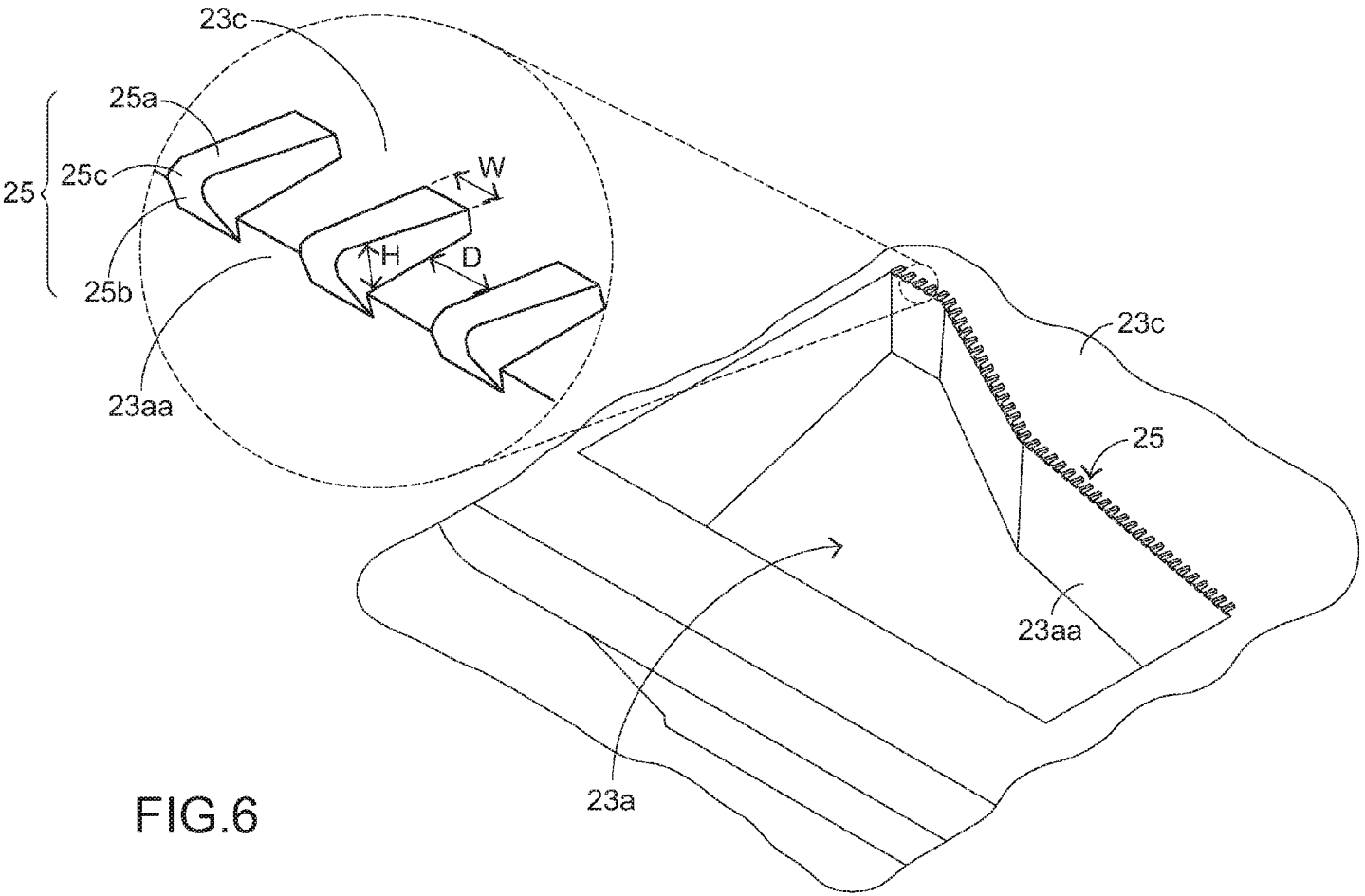
FIG. 6 is a schematic enlarged fragmentary view illustrating the paper placement platform of FIG. 5.

Hereinafter, the components of a shredder with a clip removing structure according to an embodiment of the present invention will be illustrated with reference to FIGS. 4, 5 and 6. FIG. 4 is a schematic exploded view illustrating a shredder with a clip removing structure according to an embodiment of the present invention. FIG. 5 is a schematic perspective view illustrating a paper placement platform used in the shredder of FIG. 4. FIG. 6 is a schematic enlarged fragmentary view illustrating the paper placement platform of FIG. 5.

The shredder 2 comprises an upper cover 20, a casing 21, a shredding knife assembly 22, a paper placement platform 23, a feeding roller assembly 24, plural clip removing bulges 25, and a receptacle 26. The paper placement platform 23 comprises four recesses 23*a* and a hollow part 23*b*. Each of the four recesses 23*a* has a sidewall 23*aa*. The sidewall 23*aa* is extended downwardly from a top surface 23*c* of the paper placement platform 23. In addition, the sidewall 23*aa* is perpendicular to the top surface 23*c* of the paper placement platform 23.

As shown in FIG. 5, the four recesses 23*a* are formed in the regions adjacent to four corners of the paper placement platform 23, respectively. In addition, the hollow part 23*b* is located at a middle portion of the paper placement platform 23.

In accordance with a key feature of the present invention, plural clip removing bulges 25 are discretely protruded from and arranged on the top surface 23*c* of the paper placement platform 23 beside each recess 23*a*. Since the clip removing bulges 25 have the same shape, only the shape of a single clip removing bulge 25 will be illustrated as follows.

As shown in FIG. 6, the clip removing bulge 25 has an upper surface 25*a* and a lateral surface 25*b*. The upper surface 25*a* is a slant surface that is downwardly inclined toward the feeding roller assembly 24. The lateral surface 25*b* is extended from the upper surface 25*a* and connected with the sidewall 23*aa* of the corresponding recess 23*a*. Moreover, the lateral surface 25*b* is also a slant surface that is inclined toward the feeding roller assembly 24. In other words, the clip removing bulge 25 is a raised structure that is formed on the top surface 23*c* of the paper placement platform 23 and extended upwardly toward the region over the recess 23*a*.

Moreover, in this embodiment, the junction 25*c* between the upper surface 25*a* and the lateral surface 25*b* of the clip removing bulge 25 has an arc-shaped profile. Due to the arc-shaped profile of the junction 25*c*, the possibility of being abraded after a long use time will be reduced.

Moreover, since the upper surface 25*a* of the clip removing bulge 25 is a slant surface, the altitude of the front end of the clip removing bulge 25 and the altitude of the rear end of the clip removing bulge 25 are different. In this embodiment, the highest altitude H of the clip removing bulge 25 relative to the top surface 23*c* of the paper placement platform 23 is in the range between 0.6 mm and 1.5 mm. Moreover, the width W of the front end of the clip removing bulge 25 and the width W of the rear end of the clip removing bulge 25 are identical. Preferably, the width W is in the range between 0.6 mm and 1.5 mm. Moreover, a spacing interval D between any two adjacent clip removing bulges 25 is smaller than the width of any current commercially-available paperclip.

Figure 7:
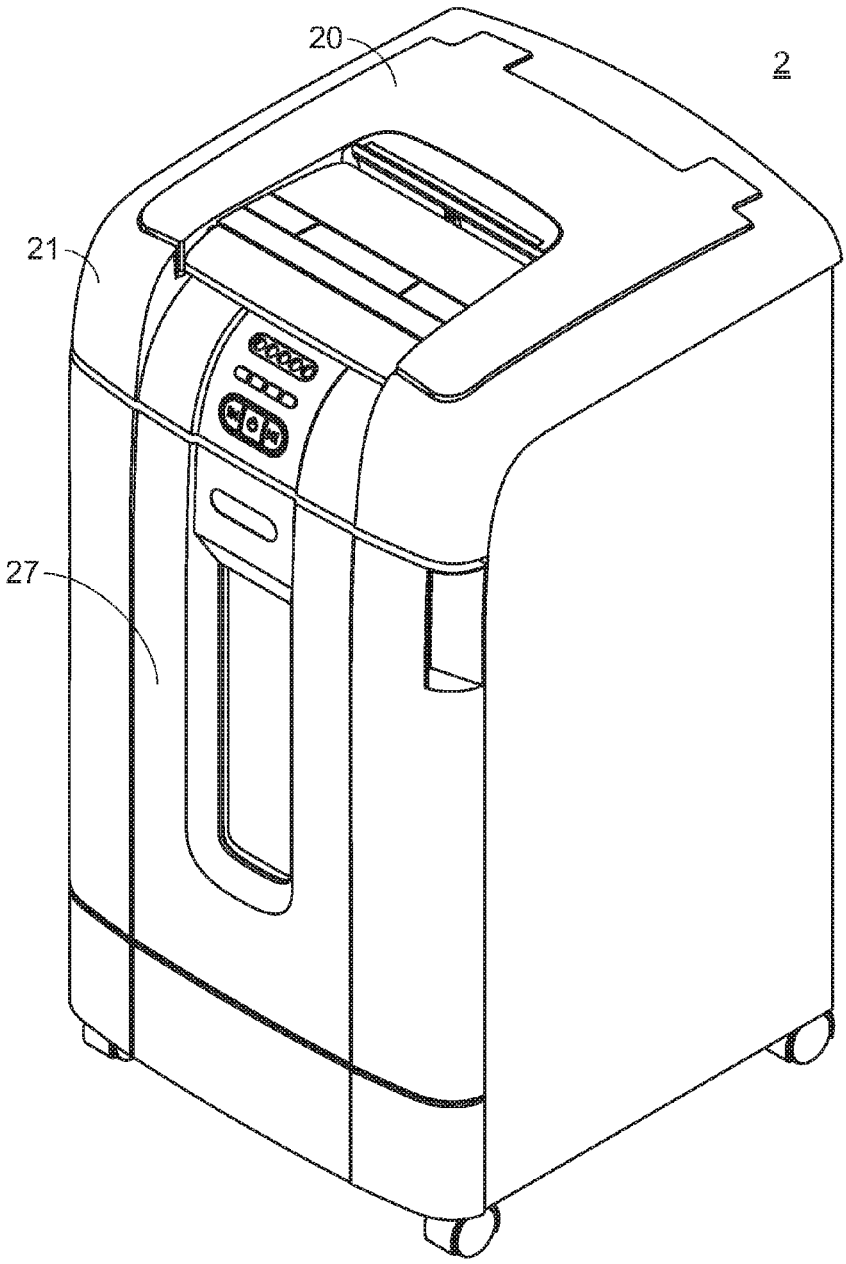
FIG. 7 is a schematic perspective view illustrating the shredder with the clip removing structure according to an embodiment of the present invention, in which the upper cover is in a close position.
Figure 8:
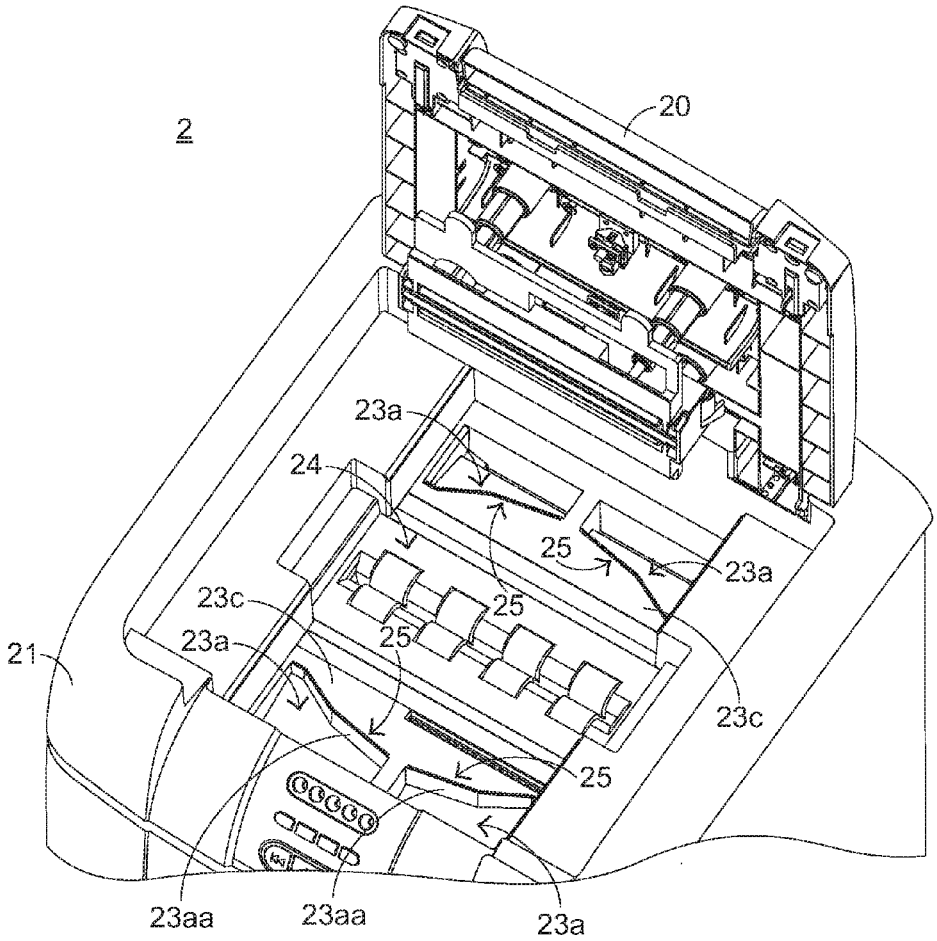
FIG. 8 is a schematic perspective view illustrating the shredder with the clip removing structure according to an embodiment of the present invention, in which the upper cover is in an open position.

Hereinafter, a process of assembling the shredder with the clip removing structure will be illustrated with reference to FIGS. 4, 7 and 8. FIG. 7 is a schematic perspective view illustrating the shredder with the clip removing structure according to an embodiment of the present invention, in which the upper cover is in a close position. FIG. 8 is a schematic perspective view illustrating the shredder with the clip removing structure according to an embodiment of the present invention, in which the upper cover is in an open position.

Firstly, the shredding knife assembly 22 is installed within the casing 21, the feeding roller assembly 24 is disposed over the shredding knife assembly 22, and the paper placement platform 23 is disposed over the feeding roller assembly 24. In addition, the feeding roller assembly 24 is penetrated through the hollow part 23*b* at the middle portion of the paper placement platform 23 so as to be exposed to the paper placement platform 23 (see FIG. 8).

Then, the upper cover 20 is pivotally coupled to the casing 21. In addition, the upper cover 20 may be rotated relative to the casing 21 to be selectively in an open position (see FIG. 8) or a close position (see FIG. 7). Moreover, the receptacle 26 is disposed under the casing 21.

Please refer to FIGS. 4 and 7 again. In this embodiment, the shredder 2 further comprises a door 27. By selectively opening or closing the door 27, the receptacle 26 is exposed to the front of the user or the receptacle 26 becomes a sealed space.

Figure 9:
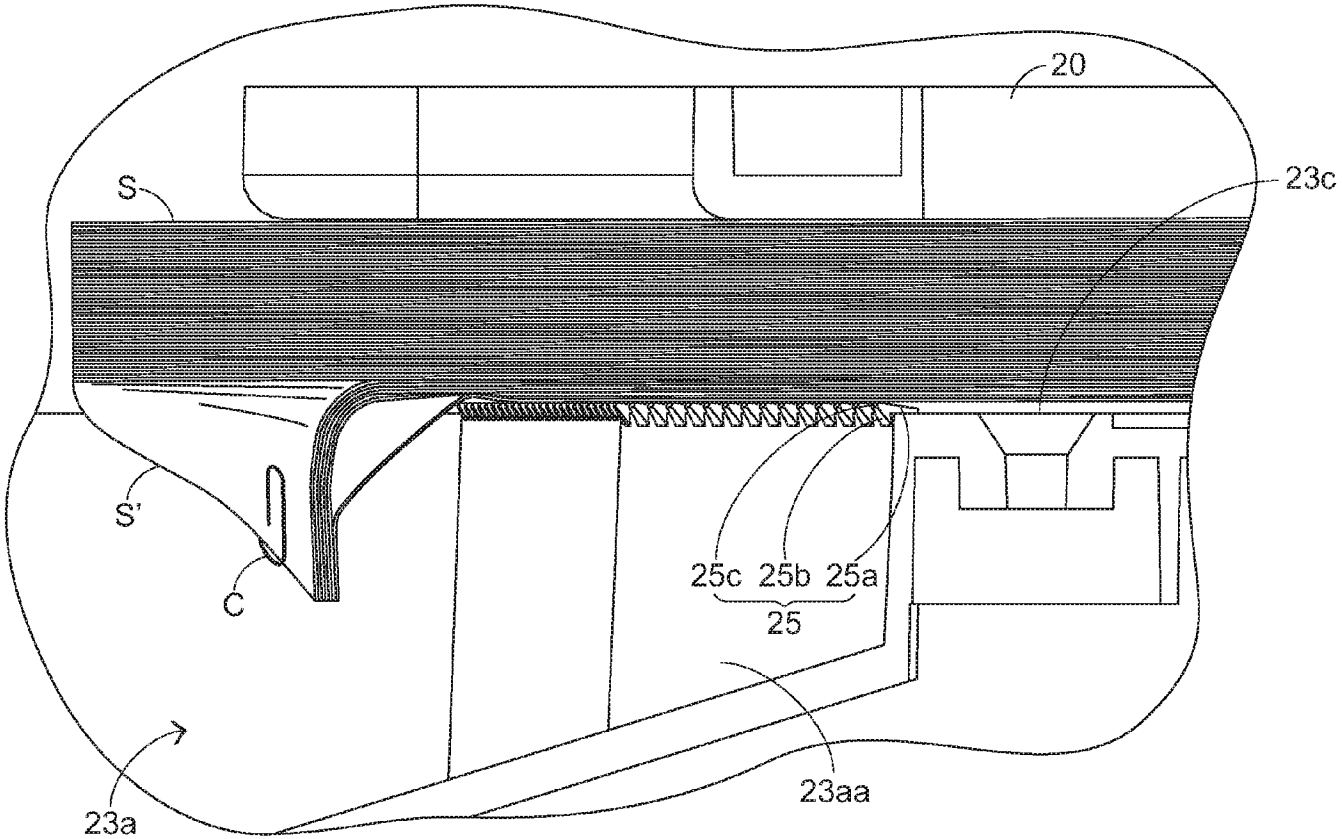
FIG. 9 is a schematic partial cross-sectional view illustrating the shredder with the clip removing structure according to an embodiment of the present invention.

Hereinafter, the operations of the shredder with the clip removing structure according to an embodiment of the present invention will be illustrated with reference to FIGS. 4, 5, 6, 8 and 9. FIG. 9 is a schematic partial cross-sectional view illustrating the shredder with the clip removing structure according to an embodiment of the present invention.

For performing the shredding operation, plural papers S are firstly placed on the top surface 23*c* of the paper placement platform 23, and then the upper cover 20 is rotated to be in the close position (see FIG. 7). Meanwhile, the plural papers S are pressed by the overlying upper cover 20, and the four corners of the stack of the plural papers S are respectively located over the four recesses 23*a* (see FIG. 9).

For clarification and brevity, only one corner of the stack of the plural papers S is shown in FIG. 9. The other corners of the stack of the plural papers S are similar to the corner shown in FIG. 9, and are not redundantly shown in other drawings.

When the shredding operation is started, the plural papers S are pulled by the feeding roller assembly 24 one by one from the middle portion of the bottommost paper S, and thus the plural papers S are moved toward the shredding knife assembly 22. In such way, the both ends of each of the plural papers S are also moved toward the feeding roller assembly 24. Afterwards, the plural papers S are cut into strips or fine particles by the shredding knife assembly 22. The strips or fine particles will fall down to the underlying receptacle 26.

Furthermore, if the receptacle 26 is full of the strips or fine particles of the cut papers S, the shredder 2 fails to be normally operated. Meanwhile, the door 27 should be opened to empty the receptacle 26, so that the shredder 2 can be normally operated.

In particular, when the plural papers S are fixed by the paperclip C and the bottommost paper S is moved toward the feeding roller assembly 24, the corners of the plural papers S are pulled and bent toward the corresponding recesses 23*a*. As the bottommost paper S is continuously moved, the bottommost paper S will be separated from the paperclip C (see FIG. 9). The above step of pulling the bottommost paper S is repeatedly done, so that the remaining bottommost papers S are sequentially separated from the paperclip C.

Until only the last paper S is remained, during the both ends of the last paper S are moved toward the feeding roller assembly 24, the edge S' of the last paper S is firstly transferred through the clip removing bulges 25. Meanwhile, the paperclip C is blocked by the lateral surfaces 25*b* of the clip removing bulges 25. Since the lateral surface 25*b* is a slant surface that is inclined toward the feeding roller assembly 24, the lateral surface 25*b* not only exerts a lateral pushing force on the paperclip C but also exerts a downward pushing force on the paperclip C. In such way, the paperclip C is removed by the clip removing bulges 25 more easily.

Furthermore, if the paperclip C is not completely removed from the last paper S by the clip removing bulges 25, as the edge S' of the last paper S is continuously moved, the junction 25*c* between the upper surface 25*a* and the lateral surface 25*b* of the clip removing bulge 25 is interposed into the space between the last paper S and the paperclip C. Under this circumstance, the paperclip C is hooked by the junction 25*c* of the clip removing bulge 25 until the paperclip C is separated from the last paper S.

Moreover, as mentioned above, the spacing interval D between any two adjacent clip removing bulges 25 is smaller than the width of any current commercially-available paperclip. Consequently, even if the location of the paperclip C is not aligned with any clip removing bulge 25, the paperclip C fails to be transferred through the gap between any two adjacent clip removing bulges 25. Whereas, the paperclip C is pushed by the edges of the lateral surfaces 25*b* of the two clip removing bulges 25 simultaneously until the paperclip C is separated from the last paper S.

Furthermore, as mentioned above, the upper surface 25*a* of the clip removing bulge 25 is a slant surface that is downwardly inclined toward the feeding roller assembly 24. Consequently, when the last paper S is pressed by the upper cover 20, the last paper S is bent at the junction 25*c* between the upper surface 25*a* and the lateral surface 25*b* of the clip removing bulge 25, the junction 25*c* of the clip removing bulge 25 is interposed into the space between the last paper S and the paperclip C more easily. In such way, the clip removing performance of the clip removing bulge 25 is enhanced.

After the paperclip C is separated from the last paper S, the paperclip C falls down into the receptacle through the recess 23*a*. Under this circumstance, the paperclip C can be easily cleared up by the user.

From the above embodiments, the plural clip removing bulges 25 are discretely arranged on the top surface 23*c* of the paper placement platform 23 beside each recess 23*a* and extended upwardly toward the region over the recess 23*a*. Consequently, in response to the lateral pushing force and the downward pushing force exerted by the lateral surface 25*b* of the clip removing bulge 25, the paperclip C attached on the paper S may be separated from the paper S, or the paperclip C may be hooked by the junction 25*c* of the clip removing bulge 25 to be separated from the paper S.

From the above description, the clip removing bulges of the shredder of the present invention can provide the multi-stage clip removing efficacy. Consequently, the performance of removing the paperclip is enhanced. Even if the papers fail to be completely in close contact with the paper placement platform due to vibration or other factors, the inclined lateral surface and the upward junction of the clip removing bulge can still function well. Since the plural clip removing bulges are discretely arranged on the top surface of the paper placement platform at a special spacing interval, the paperclip at an arbitrary location of the corner of the paper can be removed in a more precise manner.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A shredder with a clip removing structure, said shredder comprising:

a casing;

a shredding knife assembly disposed within said casing;

a paper placement platform disposed over said shredding knife assembly for supporting at least one paper thereon;

a feeding roller assembly arranged between said paper placement platform and said shredding knife assembly and exposed to said paper placement platform for driving movement of said paper toward said shredding knife assembly; and plural clip removing bulges discretely protruded from and arranged on a top surface of said paper placement platform and located beside a corner of said paper placement platform, wherein a spacing interval exists between each of said plural clip removing bulges and an adjacent clip removing bulge, wherein the highest altitude of each of said plural clip removing bulges relative to said top surface of said paper placement platform is in a range between 0.6 mm and 1.5 mm, and a width of each of said plural clip removing bulges is in a range between 0.6 mm and 1.5 mm, wherein during said paper is driven by said feeding roller assembly to be moved toward said shredding knife assembly and an edge of said paper is transferred through said plural clip removing bulges, a paperclip at said edge of said paper is blocked by said plural clip removing bulges, so that the paperclip is separated from said paper.

2. The shredder according to claim 1, wherein said spacing interval is smaller than a width of said paperclip.

3. The shredder according to claim 1, further comprising an upper cover, which is pivotally coupled to said casing, wherein said upper cover is rotatable relative to said casing to be selectively in an open position or a close position, wherein when said upper cover is in said close position, said paper on said paper placement platform is pressed by said upper cover.

4. The shredder according to claim 1, wherein said paper placement platform further comprises a hollow part, wherein said hollow part is located at a middle portion of said paper placement platform, and said feeding roller assembly is exposed to said paper placement platform through said hollow part.

5. A shredder with a clip removing structure, said shredder comprising:

a casing;

a shredding knife assembly disposed within said casing;

a paper placement platform disposed over said shredding knife assembly for supporting at least one paper thereon;

a feeding roller assembly arranged between said paper placement platform and said shredding knife assembly and exposed to said paper placement platform for driving movement of said paper toward said shredding knife assembly; and plural clip removing bulges discretely protruded from and arranged on a top surface of said paper placement platform and located beside a corner of said paper placement platform, wherein a spacing interval exists between each of said plural clip removing bulges and an adjacent clip removing bulge, wherein each of said plural clip removing bulges comprises an upper surface, wherein said upper surface is downwardly inclined toward said feeding roller assembly, wherein said paper placement platform comprises a recess, wherein said recess is located adjacent to said corner of said paper placement platform, and said recess comprises a sidewall extended downwardly from said top surface of said paper placement platform, wherein said plural clip removing bulges are discretely arranged on said top surface of said paper placement platform beside said recess.

6. The shredder according to claim 5, wherein each of said plural clip removing bulges further comprises a lateral surface, wherein said lateral surface is extended from said upper surface and connected with said sidewall of said recess, and said lateral surface is inclined toward said feeding roller assembly.

7. The shredder according to claim 5, further comprising a receptacle, which is disposed under said casing, wherein said paper after being cut by said shredding knife assembly and said paperclip after being transferred through said recess are accommodated within said receptacle.

8. The shredder according to claim 5, wherein said spacing interval is smaller than a width of said paperclip.

9. The shredder according to claim 5, further comprising an upper cover, which is pivotally coupled to said casing, wherein said upper cover is rotatable relative to said casing to be selectively in an open position or a close position, wherein when said upper cover is in said close position, said paper on said paper placement platform is pressed by said upper cover.

10. The shredder according to claim 5, wherein said paper placement platform further comprises a hollow part, wherein said hollow part is located at a middle portion of said paper placement platform, and said feeding roller assembly is exposed to said paper placement platform through said hollow part.

11. A shredder with a clip removing structure, said shredder comprising:

a casing;

a shredding knife assembly disposed within said casing;

a paper placement platform disposed over said shredding knife assembly for supporting at least one paper thereon;

a feeding roller assembly arranged between said paper placement platform and said shredding knife assembly and exposed to said paper placement platform for driving movement of said paper toward said shredding knife assembly; and plural clip removing bulges discretely protruded from and arranged on a top surface of said paper placement platform and located beside a corner of said paper placement platform, wherein a spacing interval exists between each of said plural clip removing bulges and an adjacent clip removing bulge, wherein each of said plural clip removing bulges comprises an upper surface, wherein said upper surface is downwardly inclined toward said feeding roller assembly, wherein said paper placement platform comprises four recesses, wherein said four recesses are respectively located adjacent to four corners of said paper placement platform, and each of said four recesses comprises a sidewall extended downwardly from said top surface of said paper placement platform, wherein said plural clip removing bulges are discretely arranged on said top surface of said paper placement platform beside each of said four recesses.

12. The shredder according to claim 11, wherein each of said plural clip removing bulges further comprises a lateral surface, wherein said lateral surface is extended from said upper surface and connected with said sidewall of said corresponding recess, and said lateral surface is inclined toward said feeding roller assembly.

13. The shredder according to claim 11, further comprising a receptacle, which is disposed under said casing, wherein said paper after being cut by said shredding knife assembly and said paperclip after being transferred through said recesses are accommodated within said receptacle.

14. The shredder according to claim 11, wherein said spacing interval is smaller than a width of said paperclip.

15. The shredder according to claim 11, further comprising an upper cover, which is pivotally coupled to said casing, wherein said upper cover is rotatable relative to said casing to be selectively in an open position or a close position, wherein when said upper cover is in said close position, said paper on said paper placement platform is pressed by said upper cover.

16. The shredder according to claim 11, wherein said paper placement platform further comprises a hollow part, wherein said hollow part is located at a middle portion of said paper placement platform, and said feeding roller assembly is exposed to said paper placement platform through said hollow part.

* * * * *